US008651008B2

(12) United States Patent
Kocher

(10) Patent No.: US 8,651,008 B2
(45) **Date of Patent: *Feb. 18, 2014**

(54) HIGHLY SURVIVABLE URBAN UTILITY VEHICLE (HSUUV)

(71) Applicant: The Right Problem LLC, Arlington, VA (US)

(72) Inventor: Robert William Kocher, Arlington, VA (US)

(73) Assignee: The Right Problem LLC, Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/727,308

(22) Filed: Dec. 26, 2012

(65) Prior Publication Data

US 2013/0112072 A1 May 9, 2013

Related U.S. Application Data

(63) Continuation of application No. 12/153,269, filed on May 15, 2008, now Pat. No. 8,365,648, which is a continuation of application No. 11/507,089, filed on Aug. 21, 2006, now Pat. No. 7,401,540.

(51) Int. Cl.
*F41H 7/02* (2006.01)

(52) U.S. Cl.
USPC ..... 89/36.08; 89/929

(58) Field of Classification Search
USPC ..... 89/36.6–36.09, 929, 36.11, 89/36.14–36.17
See application file for complete search history.

(56) References Cited

U.S. PATENT DOCUMENTS 3,855,898 A * 12/1974 McDonald ..... 89/36.08
8,365,648 B2 * 2/2013 Kocher ..... 89/36.08

* cited by examiner

*Primary Examiner* — Michael Carone
*Assistant Examiner* — Reginald Tillman, Jr.
(74) *Attorney, Agent, or Firm* — Andrew Wickmann

(57) ABSTRACT

The Highly Survivable Urban Utility Vehicle (HSUUV) provides a novel way to balance the concerns of armor, mobility and cost. Prior art distributes armor to protect all areas of the vehicle evenly, thereby distributing the maximum armor weight capacity evenly. The HSUUV provides armored protection in levels, which vary depending on the location of the armor and that location's ballistic threat. Entrance to the HSUUV is located in location(s) other than the traditional side door(s) so as to provide additional armored protection in the area receiving the greatest ballistic threat. Using the HSUUV, soldiers can safely and quickly enter areas that they otherwise would have had to fight and sustain casualties to enter. The vehicle will give United States forces an unprecedented amount of flexibility, allowing for better strategic and tactical decisions.

6 Claims, 4 Drawing Sheets

HIGHLY SURVIVABLE URBAN UTILITY VEHICLE (HSUUV)

CROSS-REFERENCED TO RELATED APPLICATIONS

This application is a continuation of application Ser. No. 12/153,269, filed on May 15, 2008 (now pending), which was a continuation of application Ser. No. 11/507,089, filed Aug. 21, 2006 (now U.S. Pat. No. 7,401,540, issued Jul. 22, 2008), the contents of which are incorporated herein by reference.

BACKGROUND OF THE INVENTION

1. Field of the Invention

This invention relates to the armoring of wheeled vehicles to better protect the vehicle's occupants from various types of threats and attacks.

2. Description of Related Art

A central problem in the field of military vehicles is the difficulty in armoring. Effective armoring inherently consumes much of a vehicle's load carrying capacity, making for deceased mobility, decreased vehicle life, and increased cost. Current art, such as HMMWVs (High-Mobility, Multi-Purpose Wheeled Vehicles) modified with armor kits or armored HMMWVs, essentially create a box of armor surrounding the occupants of the vehicle, distributing the armor evenly around the exterior of the vehicle. While the occupants are evenly protected from attack from all angles, the level of this protection is relatively low. Current art is particularly unable to defeat roadside improvised explosive devices (IEDs), other explosive munitions such as rocket propelled grenades (RPGs), and armor piercing rounds. This failure results in the deaths of many US soldiers as well as tactical difficulties. Not only is current art relatively ineffective at protecting the occupants of the vehicle, but these vehicles are highly recognizable to enemy forces, often very slow, and are very costly.

BRIEF SUMMARY OF THE INVENTION

The object of the Highly Survivable Urban Utility Vehicle (HSUUV) is to provide soldiers with a vehicle that is effective at protecting them from IEDs, explosive munitions and armor piercing rounds. One major advantage of the HSUUV is the speed and mobility of the vehicle, due to its concentration of innovative armor. Another advantage is its relatively low cost, which will allow for a large deployment of these vehicles.

The HSUUV (Highly Survivable Urban Utility Vehicle) is a truly innovative approach to solving high levels of ballistic threat protection problems, and other applications that require relatively fast, and inconspicuous armored vehicles. Through the use of an innovative armor system and commercial vehicles, such as flat-bed trucks, the HSUUV offers a novel solution to the problem of having an armored vehicle that is both highly mobile and heavily armored.

The HSUUV consists of a commercial vehicle, heavily modified to protect the occupants, but modified in a very novel way. Instead of evenly protecting the interior of the vehicle with relatively thin armor or lower protection levels all around the cab of the vehicle, the HSUUV replaces the doors of a vehicle such as a the commercial vehicle with extremely thick side armor. Instead of doors, there is an entrance large enough to fit a soldier with gear either in the rear of the cab, the top, or both. The front and rear of the HSUUV can be armored as well, but much less so, while the bottom can also be fitted with limited protection as well with an under armor pan. The main-heavy armor is specifically designed to protect the driver and passengers from the most likely attack in the intended conditions of use, that is, from a side attack, such as an ambush as the vehicle speeds by. In these conditions, the HSUUV could withstand being attacked by significantly higher threats that would normally destroy conventional vehicles; and, due to its relatively low weight, it could quickly get away from the threat. Instead of trading heavy armoring for load carrying capacity and speed, the HSUUV reaches a compromise of heavy armoring only where it is necessary, which allows it to be both well protected and highly mobile.

As the doors on the HSUUV have been replaced with heavy armor, there is either an entrance in the rear of the cab or through the top, or both. This entrance is large enough for a soldier with gear to enter.

Item 1 is the front of the HSUUV.

Item 2 is the special HSUUV side armor.

Item 3 is a reinforced windshield.

Item 4 is a rear entry to the HSUUV.

Item 5 is the HSUUV under-armor.

Item 6 is Kevlar Liner or other liner.

Item 7 is 7039 Aluminum or other light metal aluminum armor.

Item 8 is Rolled Homogeneous Armor Steel (RHA) or similar armor.

Item 9 is an Explosive Reactive Armor (ERA).

Item 10 is firing zone A, where the most fire or greatest threat is anticipated.

Item 11 is firing zone B, the front of the vehicle.

Item 12 is firing zone C, the back of the vehicle.

Item 13 is firing zone D, the bottom of the vehicle.

DETAILED DESCRIPTION

Figure 1:
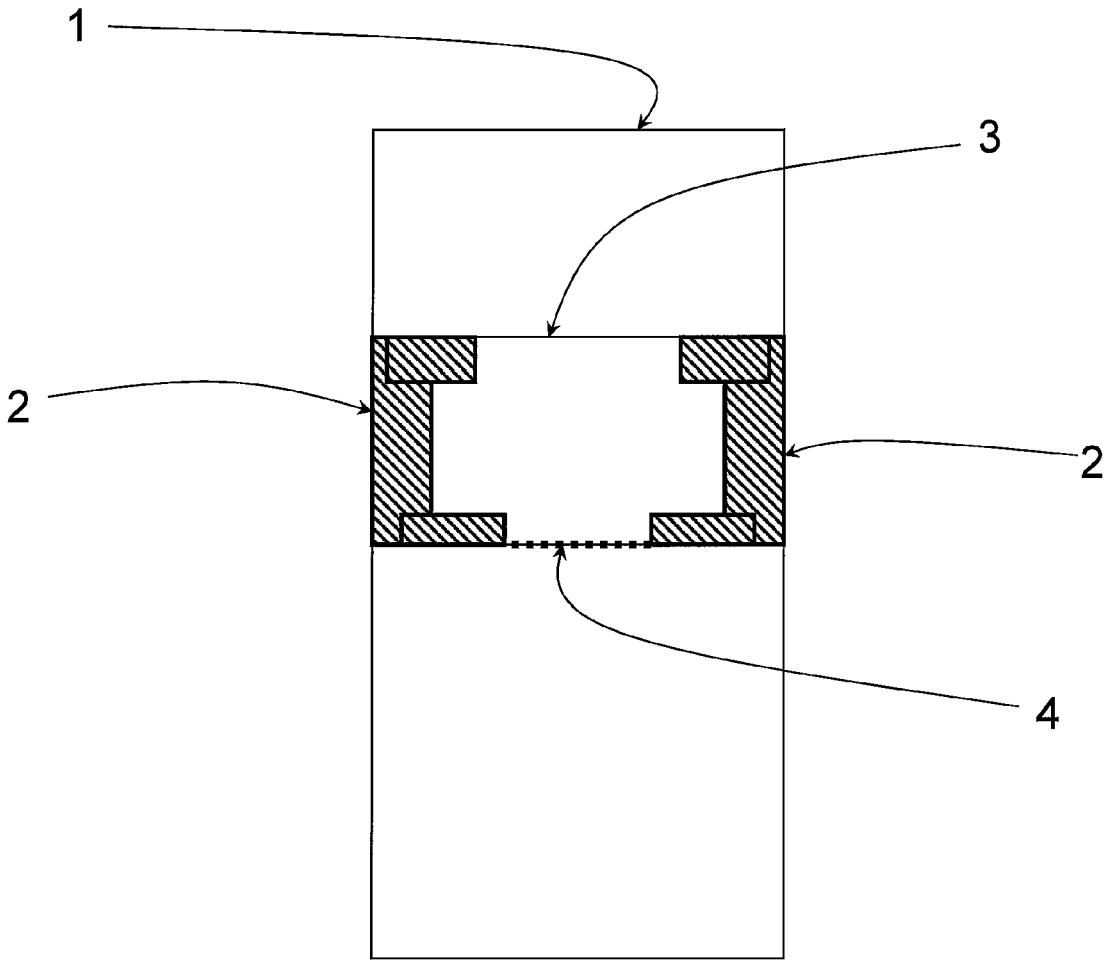
FIG. 1 shows a top down view of the HSUUV.

Description—FIG. 1

FIG. 1 depicts a top down view of the HSUUV, with a reinforced windshield 3 on the front 1. On the sides, extending to cover the occupants is the specially designed HSUUV side armor 2. In the rear of the cab is an entrance 4.

Figure 2:
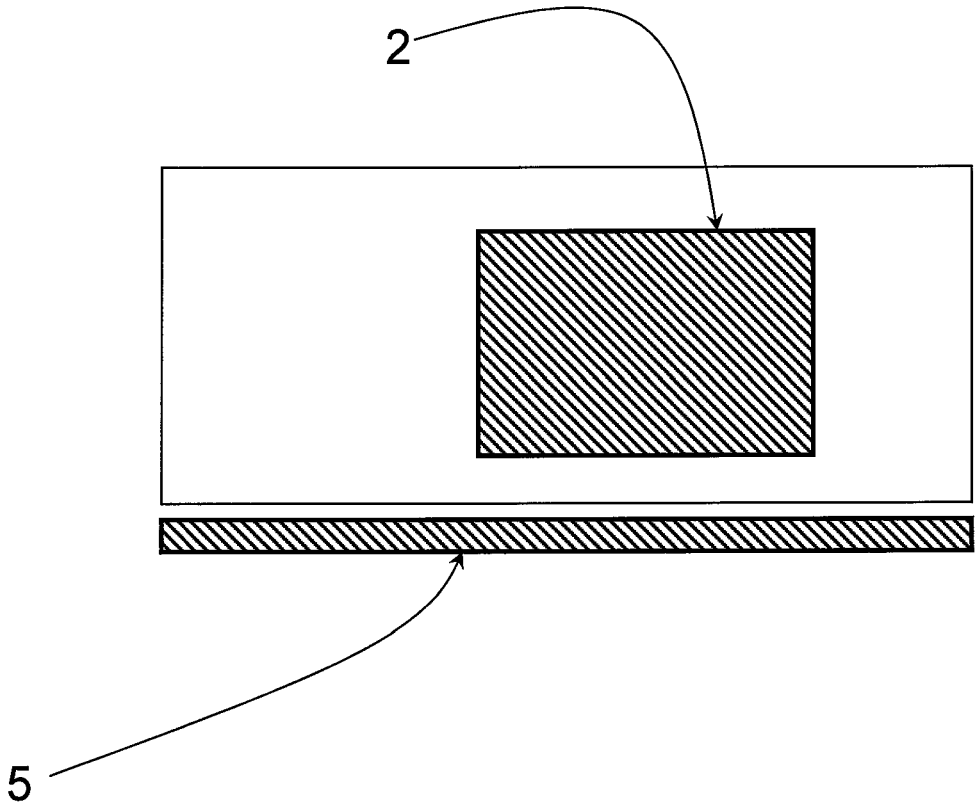
FIG. 2 shows a side view of the HSUUV.

Description—FIG. 2

FIG. 2 depicts a side view of the HSUUV. There is side armor 2 protecting the occupants, as well as under-armor 5 protecting the bottom of the vehicle.

Figure 3:
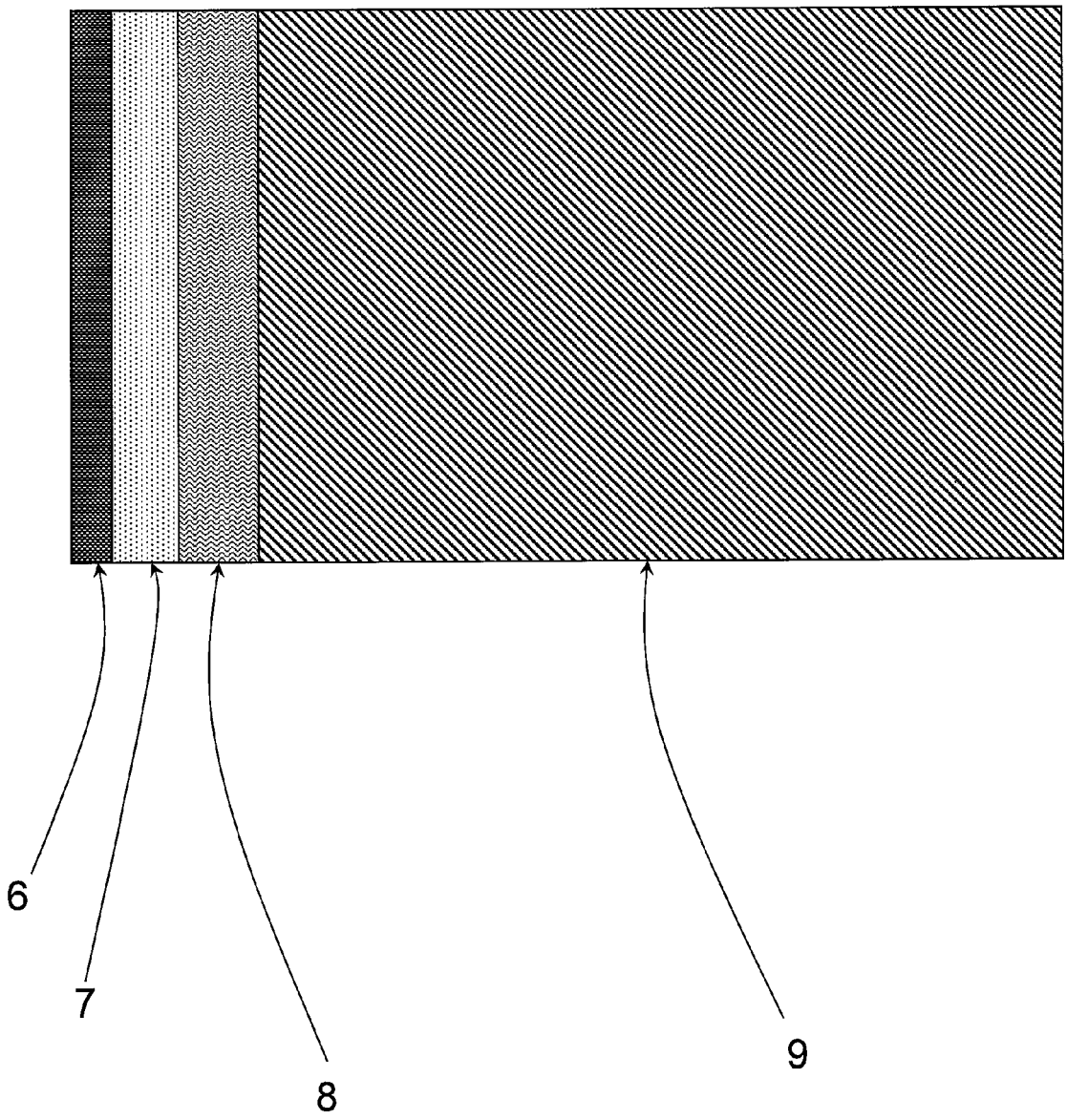
FIG. 3 shows an example of HSUUV armor.

Description—FIG. 3

FIG. 3 depicts a cross section of an example of the preferred embodiment of an HSUUV armor. This example consists of a ¾ inch Kevlar Liner 6, a one inch layer of 7039 aluminum 7, a 1¼ inch RHA layer 8 and a 12.2 inch layer of ERA 9. Other embodiments of this heavy armor are also possible.

Figure 4:
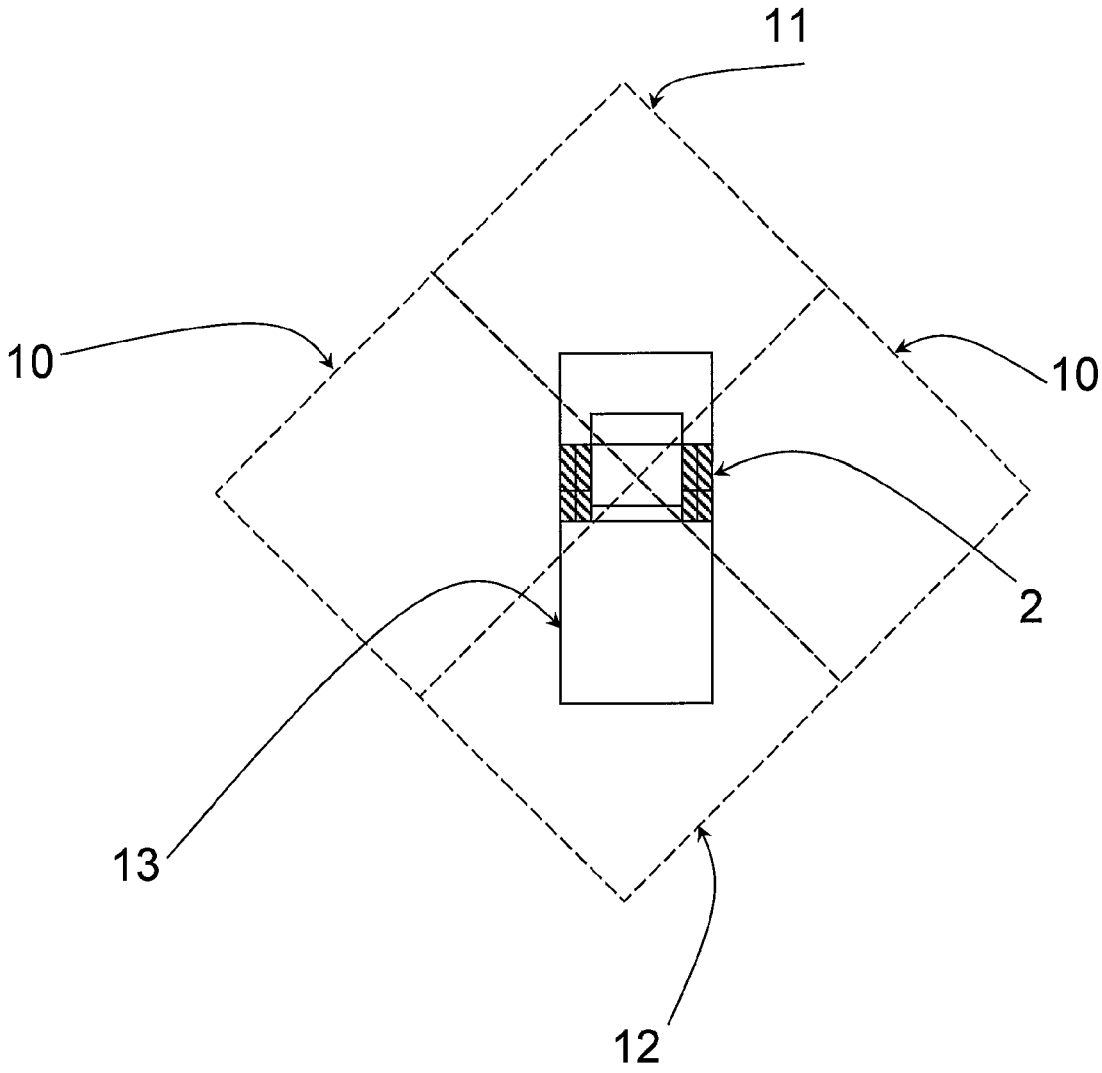
FIG. 4 shows an explanation of the different zones of fire the HSUUV is likely to encounter.

Description—FIG. 4

FIG. 4 depicts a top down view of the HSUUV with an explanation of the firing zones that the vehicle is likely to encounter. Zone A 10 is where the most fire is anticipated, and thus a huge amount of armor is concentrated. Zone B 11 is the front of the HSUUV, where minimal fire is anticipated and thus light armor is used. Zone C 12 is the back of the HSUUV where light fire is expected and thus light armor is used. Zone D 13 is the underside of the vehicle, which could be vulnerable to improvised explosive devices, thus under armor is installed there.

The Highly Survivable Urban Utility Vehicle provides a novel way to balance the concerns of armor, mobility and cost. All vehicles in this context have a maximum weight that they cannot exceed and remain useful. Prior art weights down the vehicle with light armor protecting the entire vehicle, distributing this maximum weight evenly. However, the HSUUV strongly protects only those areas that are most likely to be attacked, allowing those areas a level of protection never before possible.

Using the HSUUV, soldiers can safely and quickly enter areas that they otherwise would have had to fight and sustain casualties to enter. This will give US forces an unprecedented amount of flexibility, allowing for better strategic and tactical decisions.

While the above description contains many specificities, these should not be construed as limitations on the scope of the invention, but rather as an exemplification of one of the preferred embodiments. Many other variations are possible, including but not limited to, a HSUUV using a custom made, instead of commercial, vehicle, a HSUUV including an integrated weapons system, or a HSUUV designed to withstand other specific types of weapons.

What is claimed is:

1. A wheeled armored vehicle system, comprising:

a wheeled vehicle having a cab, the cab having two sides, a top, a front, a rear, and a bottom, the cab being a central portion of the vehicle for substantially surrounding one or more passengers;

relatively thick armor sufficient to withstand assault with one or more specific types of munitions disposed on select areas of the vehicle including at least portions of the two sides of the cab; and relatively thin armor insufficient to withstand assault with the specific types of munitions disposed on select areas of the vehicle including select areas of the cab; and wherein the relatively thick armor comprises a layer of a synthetic fiber, a layer of aluminum, a layer of rolled homogenous armor, and a layer of explosive reactive armor.

2. The wheeled armored vehicle of claim 1, wherein a surface of the layer of synthetic fiber immediately contacts a first surface of the layer of aluminum, a second surface of the layer of aluminum immediately contacts a first surface of the layer of rolled homogenous armor, and a second surface of the layer of rolled homogenous armor immediately contacts a surface of the layer of explosive reactive armor.

3. A wheeled armored vehicle system, comprising:

a wheeled vehicle having a cab, the cab having two sides, the cab being a central portion of the vehicle for substantially surrounding one or more passengers;

relatively thick armor sufficient to withstand assault with one or more specific types of munitions disposed on select areas of the vehicle including at least portions of the two sides of the cab; and relatively thin armor insufficient to withstand assault with the specific types of munitions disposed on select areas of the vehicle including one or more other areas of the cab, wherein the relatively thick armor is of sufficient weight that if relatively thick armor were disposed on the other areas of the cab, the wheeled vehicle would exceed its maximum weight and be rendered not useful.

4. The wheeled armored vehicle of claim 3, wherein the specific types of munitions include one or more armor piercing rounds.

5. The wheeled armored vehicle of claim 3, wherein the specific types of munitions include an improvised explosive device.

6. The wheeled armored vehicle of claim 3, wherein the specific types of munitions include one or more rocket propelled grenades.

* * * * *